US005836242A

United States Patent [19]

Aberg

[11] Patent Number: 5,836,242

[45] Date of Patent: Nov. 17, 1998

[54] CALENDERING SYSTEM INCLUDING A BELT HAVING AN ADAPTABLE WEB-CONTACTING SURFACE

[75] Inventor: Bo-Christer Aberg, Halmstad, Sweden

[73] Assignee: Albany Nordiskafilt AB, Halmstad, Sweden

[21] Appl. No.: 750,411

[22] PCT Filed: May 26, 1996

[86] PCT No.: PCT/SE95/00597

§ 371 Date: Dec. 9, 1996

§ 102(e) Date: Dec. 9, 1996

[87] PCT Pub. No.: WO95/34715

PCT Pub. Date: Dec. 12, 1995

[30] Foreign Application Priority Data

Jun. 15, 1994 [SE] Sweden ..... 9402094

[51] Int. Cl.[6] ..... D21G 1/00; B30B 3/04

[52] U.S. Cl. ..... 100/327; 100/153; 100/155 R; 162/358.4; 162/358.5

[58] Field of Search ..... 100/151, 153, 100/155 R, 161–169, 176, 306, 327, 103; 162/358.2–358.5

[56] References Cited

U.S. PATENT DOCUMENTS

| | | | |
|---|---|---|---|
| 2,997,406 | 8/1961 | Freeman et al. . | |
| 4,552,620 | 11/1985 | Adams . | |
| 4,697,511 | 10/1987 | Davis et al. | 100/153 |
| 4,701,368 | 10/1987 | Kiuchi et al. | 162/358.4 |
| 4,908,103 | 3/1990 | Cronin et al. | 162/358.4 |
| 4,973,383 | 11/1990 | Filzen | 162/358.4 |
| 4,976,820 | 12/1990 | Laapotti . | |
| 5,131,324 | 7/1992 | Lassila et al. | 100/153 |
| 5,163,364 | 11/1992 | Bubik et al. | 100/153 |
| 5,251,551 | 10/1993 | Abe et al. . | |
| 5,400,707 | 3/1995 | Neider et al. . | |
| 5,483,873 | 1/1996 | Koivukunnas et al. | 100/153 |

FOREIGN PATENT DOCUMENTS

| | | |
|---|---|---|
| 0188399 | 7/1986 | European Pat. Off. . |
| 6-200496 | 7/1994 | Japan . |

OTHER PUBLICATIONS

Boyer. H.E., Hardness Testing, Oh., ASM International, 1987. p. 135.

*Primary Examiner*—Stephen F. Gerrity
*Attorney, Agent, or Firm*—Kane, Dalsimer, Sullivan, Kurucz, Levy, Eisele and Richard, LLP

[57] ABSTRACT

A calendering system in a papermaking or board manufacturing process, the system comprising at least one press nip, an endless calender belt (30) having a core (32) and a compressible, elastic material bonded to the core (32), as well as a paper or paperboard web (16) which passes together with the belt (30) through the press nip and the dewatering of which is completely or at least substantially completely terminated earlier in the manufacturing process. The calender belt (30) has in its thickness direction a first hardness on the side (34) of the core (32) closest to the web (16) and a hardness on the opposite side (36) of the core (32) that is higher than the first hardness. The first hardness is so selected in relation to the web (16) that the surface (38) of the calender belt (30) engaging the web (16) can adapt its shape in the press nip (14) to unevennesses in the surface (20) of the web (16).

18 Claims, 4 Drawing Sheets

CALENDERING SYSTEM INCLUDING A BELT HAVING AN ADAPTABLE WEB-CONTACTING SURFACE

BACKGROUND OF THE INVENTION

1. Field of the Invention

The present invention generally relates to a system for calendering a web of paper, paperboard or the like. More specifically, the invention relates to a calendering system of the type using an endless, compressible and elastic calender belt passing, together with the web, through a press nip.

2. Description of the Prior Art

Paper or paperboard is calendered during manufacture with a view to imparting to it increased surfaces smoothness and gloss. In many printing papers, calendering is necessary to provide a sufficiently high printing quality. Calendering is carried out both on coated and non-coated paper or paperboard.

Calendering can be performed on-line in a papermaking or board machine immediately after the drying section thereof. In some configurations, the web is calendered at the end of the drying section. In on-line calendering, use is traditionally made of a machine calender comprising at least one press nip between two hard rolls.

Calendering can also be performed off-line, i.e. substantially separate from the papermaking or board machine, in which case use is traditionally made of a so-called supercalender, which is made up of a relatively large number of rolls placed one upon the other in a vertical stack. Normally, every other roll in the supercalender is hard and every other is of a softer material, the side of the web running on the hard roll receiving increased gloss. A more uniform treatment of the web can be achieved if the relative positions of the hard and soft rolls are changed at the centre of the supercalender.

Also in on-line calendering, calenders with elastic rolls ("soft calendering") have been developed. The soft calender, which can thus be arranged on-line after the papermaking or board machine or a coating unit, normally has a relatively small number of rolls. In soft calendering, each nip is formed between a heated steel roll and an associated elastic roll, for example a polymer-coated roll. Heating, which makes the web soften in the nip, is necessary for the paper to become sufficiently smooth and glossy despite the small number of rolls. The elasticity of the roll in a soft calender entails that the press nip becomes extended, this in turn resulting in a flatter pressure pulse in the soft calender, whereby the pressure force can advantageously be limited as compared with a machine calender.

It is generally known, for example as described in EP-A1-0 361 402 with reference to FIGS. 1 and 2 therein, that there is an essential difference in the calendering result achieved with a machine calender using hard rolls only, on the one hand, and a soft calender using one hard, heated roll and one elastic roll, on the other. A machine calender with hard rolls calenders to a constant web thickness, however with an undesired density variation in the web as a result because of the high, localised pressure pulse giving a comparatively stronger compression of the thicker portions of the web. A soft calender, on the other hand, calenders to a more constant web density, but instead yields a web which suffers from remaining unevenness, i.e. non-constant thickness, and poorer gloss.

EP-A1-0 361 402 proposes in a soft calender to provide the elastic side of the press nip by means of a separate, relatively long calender belt which passes in an endless path around this roll and spaced from the periphery thereof outside the nip. Thus, the paper or paperboard web is located in the nip between the elastic, endless belt and the hard roll. By such a design, the calender belt, which is heated in the press nip by heat from the heated, hard roll, can be cooled during its return travel in the closed loop.

DE 36 32 692 discloses the use of an elastic calender belt which, together with the paper or paperboard web to be calendered, passes through a press nip, e.g. in a supercalender, in an endless path around a hard roll and an additional roll parallel thereto.

To further extend the press nip in soft calenders with a view to further reducing the maximum pressure of the pressure pulse, it has also been suggested, in U.S. Pat. No. 5,163,364, to use in a soft calender a press design of substantially the same type as in so-called shoe presses, which are used in the press section of papermaking or board machines. Such soft calenders have an extended press nip formed between a rotating and heated hard roll, on the one hand, and a matching, substantially stationary, concave support element, on the other, the paper or paperboard web passing through the nip along with a press casing in the form of an endless belt, which in the nip is located between the web and the support element. The calender belt passes in an endless path around the support element or the"shoe" and, as in the shoe press of a press section, is impermeable on the shoe side. No detailed description of the calender belt is given in U.S. Pat. No 5,163,364.

WO 94/05853 gives another example of a press device which is said to be usable in soft calendering and which has an extended press nip formed between a rotating roll and a shoe.

In respect of endless calender belts for use as a press casing in a glazing or calendering device, it is further known, from DE 43 22 322, to design the belt asymmetrically in such a manner that the roughness of its paper side is essentially lower than the roughness of the opposite belt side.

As disclosed e.g. in U.S. Pat. No. 4,552,620, known endless calender belts for soft calendering are traditionally made up of a woven fibre base or core impregnated to the desired thickness, either on one or both sides, with a suitable impregnating substance, generally polyurethane.

A general problem of the above-mentioned known calendering techniques is that there is always an undesired compromise between smoothness and gloss, on the one hand, and constant density, on the other. Moreover, undesired thickness changes often occur in the web as a whole during the calendering process. In other words, if the thickness of the uneven surface layer of the web is designated $\Delta$ and the remaining thickness is designated T, then one generally aims at eliminating $\Delta$ while maintaining T constant. With today's calendering techniques, it is often necessary, depending on the contemplated use of the calendered paper or paperboard, to choose one parameter before the other. For example, one may consider the case where an image is to be printed on the paper or paperboard after calendering. Patchiness/roughness of the web as a result of poor calendering may then yield a visually poor image, but on the other hand a non-uniform density of the web may entail that the colouring/colour absorption of the image becomes irregular, this also deteriorating the image.

It is true that attempts have previously been made, as disclosed in the above-mentioned EP 0 361 402, with a view to counteracting local load peaks, to provide a more uniform load distribution on the web in the press nip by using an elastic and compressible calender belt whose elasticity is so adapted that the belt in the press nip can follow the surface roughness of the web. One problem of this known technique is however, as specifically stated in EP 0 361 402, that if the belt is made too soft, there is a risk of plastic deformation occurring in the calender belt, which drastically cuts the life thereof, whereas if the belt is made too hard, it will not be able to follow the surface roughness of the web.

SUMMARY OF THE INVENTION

A general object of the present invention is to provide a calendering system which makes it possible, as compared with the known calendering technique described above, to reduce the pressure in the press nip and at the same time provide a product which is smoother and glossier, and has a more uniform density than what is possible with today's calendering techniques.

Thus, the invention provides a calendering system in a papermaking or board manufacturing process, the system comprising at least one press nip, an endless calender belt comprising a core and a compressible, elastic material bonded to the core, as well as a paper or paperboard web which passes together with the belt through the press nip and the dewatering of which is completely or at least substantially completely terminated earlier in the manufacturing process. The novel and distinctive feature of the invention is that the calender belt in its thickness direction has a first hardness on the side of the core closest to the web, and a hardness on the opposite side of the core that is higher than the first hardness, the first hardness being so chosen in relation to the web that the surface of the calender belt engaging the web can adapt its shape in the press nip to unevennesses in the surface of the web.

The inventive system confers, in the first place, the advantage of obviating the need to compromise between, on the one hand, a sufficiently compressible material to enable the calender belt to follow the unevennesses in the web and, on the other hand, a material which is sufficiently hard to give the web an acceptable life, especially at high web speeds.

The above-mentioned advantage applies irrespective of whether the press nip in the inventive system is formed between two rotating rolls or whether the press nip is an extended press nip between one rotating roll and one substantially stationary, concave support element. In both cases, it is the side of the calender belt that faces away from the web, hereinafter referred to as the press side of the calender belt, that is subjected to the greatest mechanical action and the greatest risk of abrasion. According to the invention, the press side of the calender belt can thus be made sufficiently hard to provide an acceptable belt life, while at the same time a sufficiently low hardness can be chosen for the other side of the belt, hereinafter referred to as the web side of the calender belt.

The invention is also usable in such cases where the calender belt is used as a roll-covering in a soft calender having two rolls.

Another essential advantage of the invention is that the properties of the calender belt in the press nip can be controlled much more accurately as compared with a calender belt having one and the same hardness throughout its entire thickness.

The above-mentioned first, relatively low hardness of the web side of the belt and the above-mentioned second, relatively high hardness of the press side of the belt are preferably so chosen with respect to the unevennesses of the web that the latter do not give rise to any corresponding change in shape of the press side of the belt when this passes through the press nip. In other words, said second, relatively high hardness should always be sufficient for the calender belt to produce a firm, uniform resistance in the press nip once the unevennesses of the web have been compensated for by the softer web side of the belt. It will thus be appreciated that the inventive system at the same time exhibits both the favourable features of a traditional soft calender and the favourable features of a machine calender.

It should be emphasised that it is the hardness of the web side as a whole that is lower than the hardness of the press side as a whole. The invention also comprises in particular both cases where portions of the web side may have a higher hardness than the rest of that side, and cases where portions of the press side have a lower hardness than the rest of that side.

For example, the calender belt may have a surface layer engaging the web that has a hardness which is higher than the above-mentioned first hardness, in which case the hard surface layer should be sufficiently thin and flexible to enable the unevennesses of the web to if "propagate" through the surface layer and be compensated for by adaptation of the shape of the underlying, softer portion of the web side.

Moreover, the calender belt may, on the web side, somewhere between the web and the relatively soft portion that is to take up the unevennesses of the web, have a barrier layer of low extensibility in the machine direction (MD) and in the cross-machine direction (CD). In this way, shear movements in MD and CD of the belt, occasioned by the compression of the web side, are prevented, or at least partially prevented, from producing undesired shear forces acting on the fibres of the web in the contact surface.

The hardness of the web side of the calender belt preferably is in the range of 75–91 Shore A, and a currently especially advantageous range should be 80–91 Shore A. The hardness of the web side in the thickness direction should however always be lower than the hardness of the press side in the thickness direction. The web side and the press side may be built up of different materials. Besides, it may be preferred to have a greater thickness on the web side than on the press side.

The web side of the calender belt may exhibit a continuous or a non-continuous hardness gradient in the thickness direction, which gradient may be both positive and negative depending on the application. Such a hardness gradient may be achieved, for example, by the web side consisting of several layers of different hardness.

As to the surface structure of the calender belt, the press side should exhibit sufficient frictional properties on a rotating roll, and produce a sufficient oil film if a press shoe is instead used. The surface of the web side should be relatively fine, but exert a sufficient friction to prevent relative movement from occurring in MD. This can be achieved by providing a special friction-increasing material as surface layer on top of the rest of the web side of the belt.

The press nip of the inventive system preferably exerts an average pressure force on the web that is higher than any previous average pressure force exerted on the web in other press nips during pressing and drying, preferably higher than 4 MPa, generally in the range of 6–20 MPa.

The temperature of the heated roll may be >200° C. Preferably, the heated side of the web must not be heated further down than 6–15 $\mu$m in order that the bulk should not decrease.

The invention will now be described by means of two embodiments with reference to the accompanying drawings, where like reference numerals consistently designate like parts.

DETAILED DESCRIPTION OF THE PREFERRED EMBODIMENT

Figure 1A:
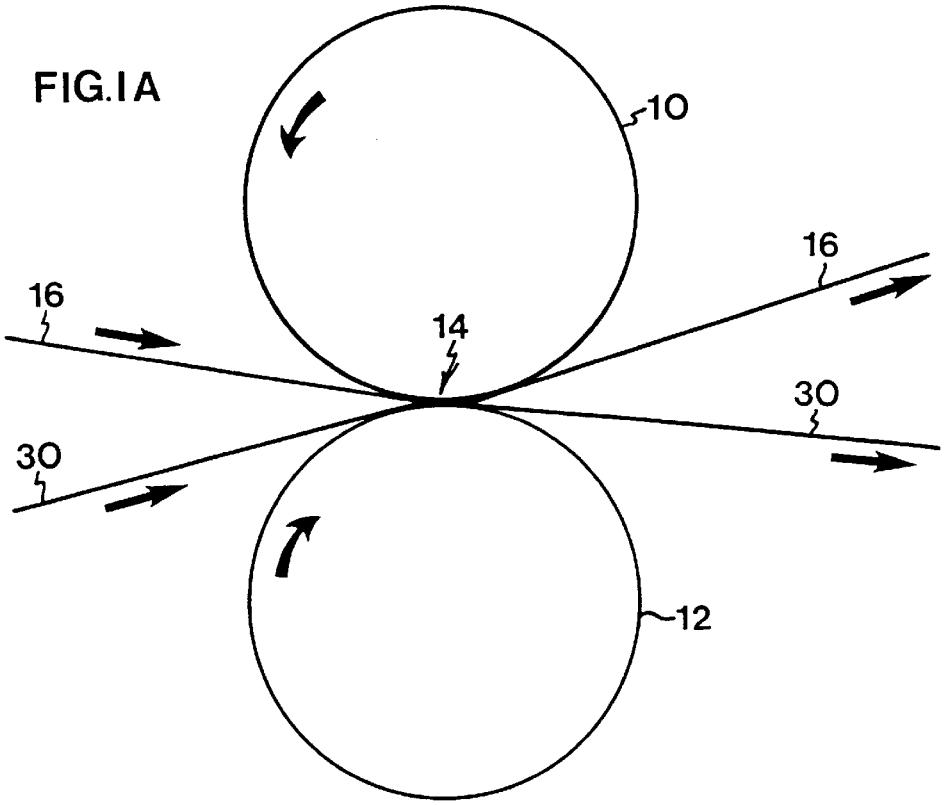
FIG. 1A schematically shows a first embodiment of a calendering system according to the invention, comprising two rotating rolls.
Figure 1B:
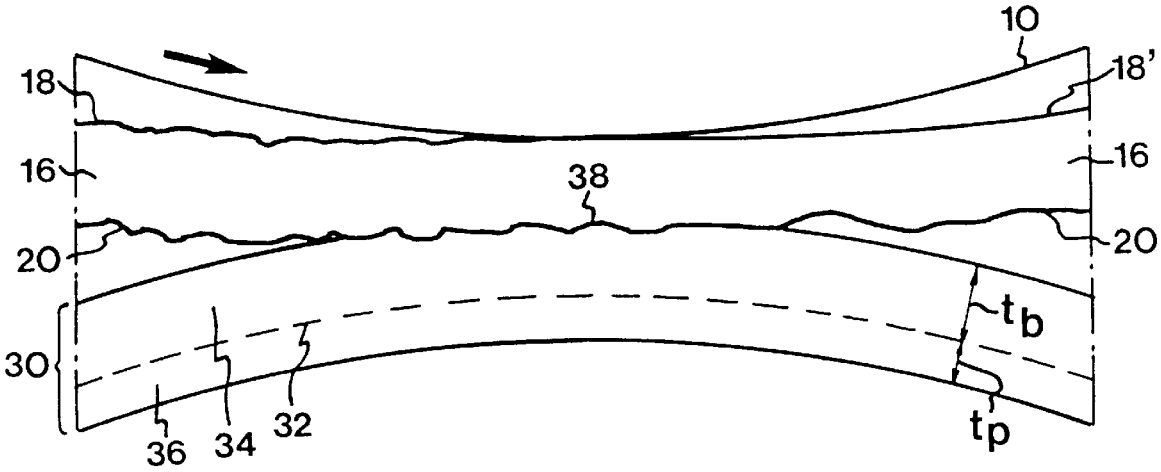
FIG. 1B is a broken-away, enlarged view of the press nip in the calendering system of FIG. 1A.

FIGS. 1A and 1B, to which reference is now made, illustrate a calendering system according to the invention, comprising two rotating rolls 10, 12, defining between them a press nip 14. The roll 10 is relatively hard, and heated. Through the press nip 14 passes a web 16 of paper or paperboard, which has been subjected to a preceding, conclusive dewatering process (pressing and drying) and which may be coated or non-coated. If coated, the coated side is facing the hard roll 10. As indicated at reference numerals 18 and 20 in FIG. 1B, the web has an uneven surface before passing through the press nip 14.

The system further comprises a calender belt 30 which travels in an endless path (not shown) around the lower roll 12, separate therefrom. The calender belt 30 comprises a core 32, schematically illustrated by a dashed line, which may consist of a woven, single- or multi-layer design, a design of non-woven threads in one or more directions, or of other designs, such as continuous layers having a perforated pattern.

As shown in FIG. 1B, the overall thickness of the belt consists of two partial thicknesses $t_b$ (b for web side) and $t_p$ (p for press side). The part 34 of the belt 30 which is facing the web 16, i.e. above the core 32 in the Figure, is referred to as the web side and has a thickness $t_b$, while the part 36 of the belt 30 which is facing away from the web 16, i.e. below the core 32, is referred to as the press side. As described above, it is foreseen according to the invention that the hardness of the web side 34 is lower than the hardness of the press side 36 and is so chosen with respect to the unevennesses 20 of the web 16 that the surface of the web side 34 is elastically adaptable in shape to the unevennesses 20 in the press nip, as indicated at reference numeral 38 in FIG. 1B.

The web side 34 may have e.g. a hardness in the range of 75–91 Shore A, and the press side 36, which at any rate should have a higher hardness, may have e.g. a hardness substantially corresponding to the hardness of traditional press belts for shoe presses in the press section.

The web 16 is calendered substantially only on its top side in FIGS. 1A and 1B, i.e. on the side facing the hard, heated roll 10, as schematically illustrated by the smoother top side 18' on the exit side of the press nip. The unevennesses 20 on the underside of the web 16 remain essentially unchanged, but can be eliminated if the web 16 is conducted through a following, similar, but reversed calendering step (not shown).

Otherwise, the embodiment in FIGS. 1A and 1B may exhibit one or more of the features of the invention described in the introductory part of the specification.

Figure 2A:
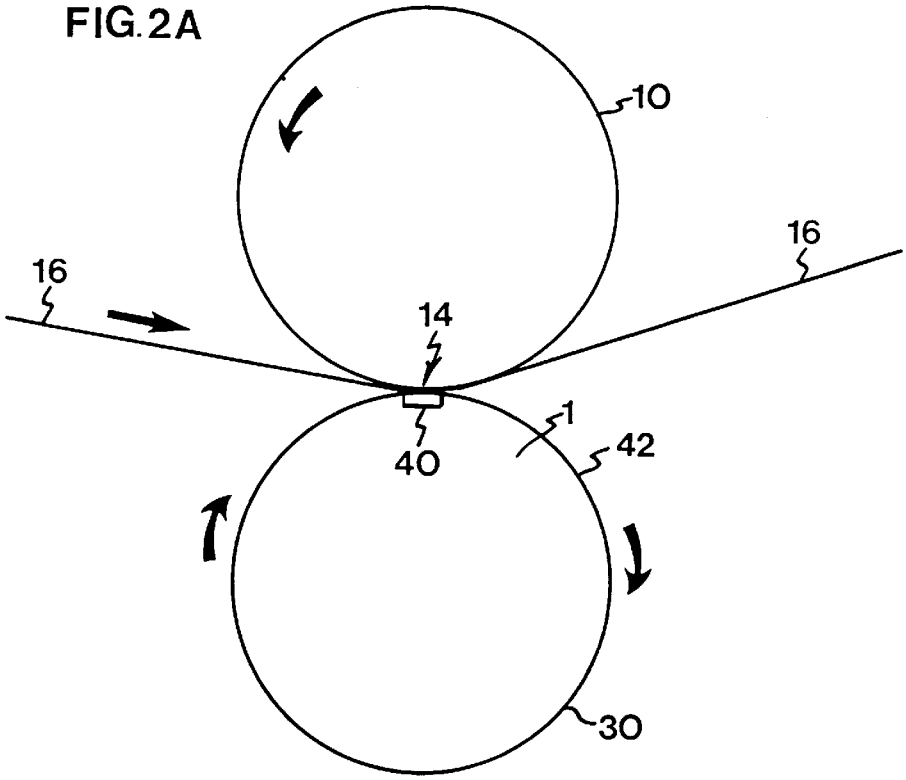
FIG. 2A schematically shows a second embodiment of a calendering system according to the invention, comprising a rotating roll and a press shoe.
Figure 2B:
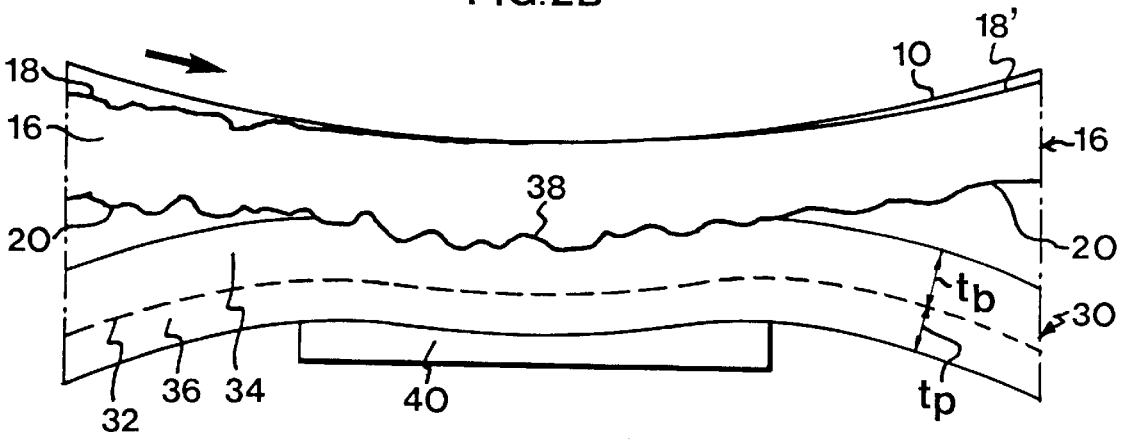
FIG. 2B is a broken-away, enlarged view of an extended press nip in the calendering system of FIG. 2A.

FIGS. 2A and 2B, to which reference is now made, illustrate a second embodiment of a calendering system according to the invention. In this embodiment, the nip 14 is instead defined by a hard, heated roll 10 and an opposed, substantially stationary press shoe 40 supported by a stationary beam (not shown). The calender belt 30 runs in an endless path around the press shoe 40, as indicated at 42. The required frictional reduction is brought about in known manner by means of an oil film on the press shoe 40, in which case the belt 30 must be impermeable. Otherwise, essentially the same features as encountered in the embodiment of FIGS. 1A and 1B apply to the embodiment of FIGS. 2A and 2B.

Moreover, the embodiment of FIGS. 2A and 2B may exhibit one or more of the features of the invention described in the introductory part of the specification.

Figure 3:
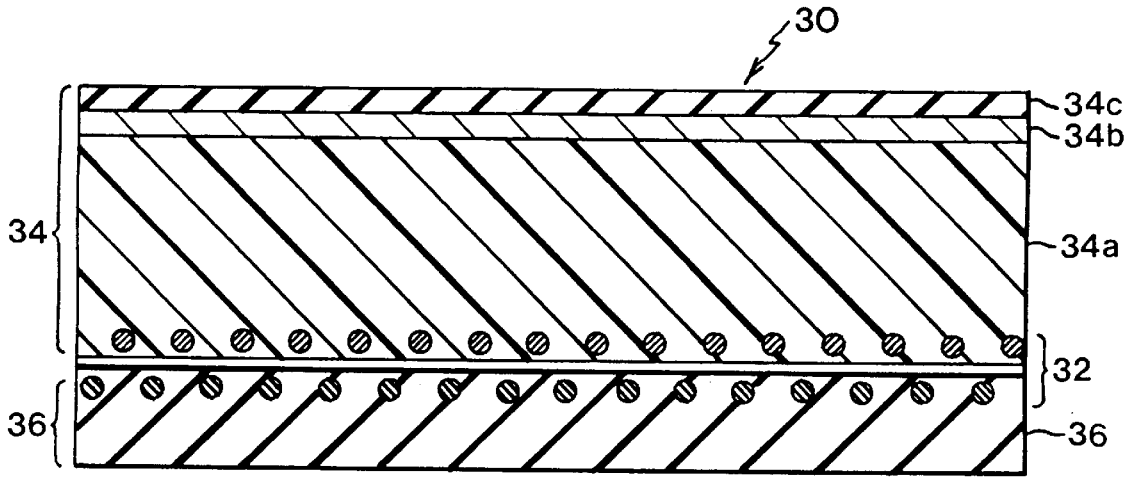
FIG. 3 is a schematic cross-section of a calender belt that can be used in the system of FIG. 1A or FIG. 2A.

FIG. 3 is a schematic cross-section of a calender belt 30 that can be used in the systems described above. In this Figure, the web side 34 of the belt 30 consists of three layers 34*a*, 34*b* and 34*c*. The layer 34*a*, which is the thickest of the three and is located closest to the core 32, exhibits the aforementioned relatively low hardness to permit the shape adaptation of the web side 34 to the unevennesses 20 of the web 16. This equalising layer 34*a* may consist e.g. of polyurethane and have a hardness of 75–91 Shore A.

The layer 34*b* is an intermediate, relatively thin barrier layer of low extensibility in MD and CD, and serves to prevent movements in MD and CD of the layer 34*a* from producing shear forces on the fibres of the web 16, giving rise to unevennesses.

Figure 4:
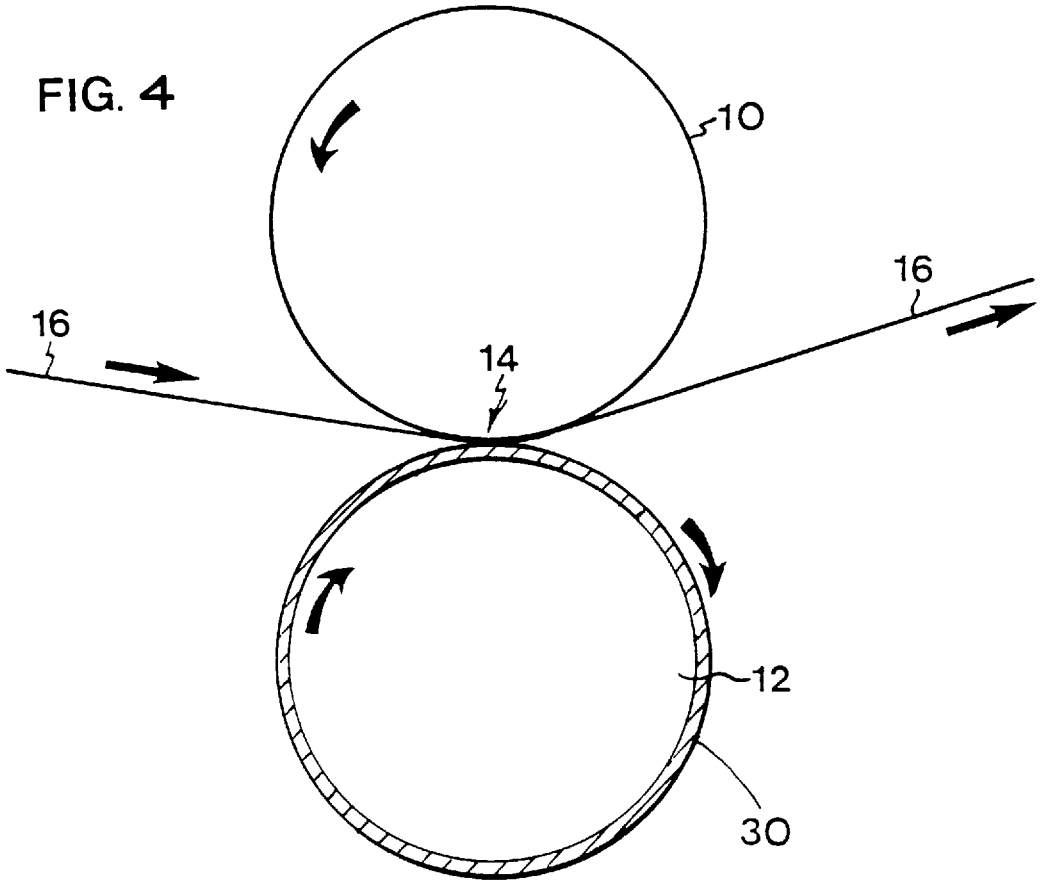
FIG. 4 schematically shows a third embodiment of a calendering system according to the invention, wherein the calender belt of FIG. 3 has a length equal to the circumference of one of two rotating rolls.

The layer 34*c*, also being relatively thin, is a hard, but flexible surface layer serving to prevent abrasion of the web side 34 of the belt 30. Alternatively, the surface layer 34*c* may be a friction-increasing layer, such as a rubber layer. FIG. 4, to which reference is now made, illustrates a third embodiment of a calendering system according to the invention. In this embodiment, the nip 14 is again defined by a hard, heated roll 10 and a lower roll 12. Calender belt 30 has a length equal to the circumference of lower roll 12, making calender belt 30 effectively a roll covering for lower roll 12.

I claim:

1. A calendering system in a papermaking or board manufacturing process, said system comprising at least one press nip (14) and an endless calender belt (30) comprising a core (32) and a compressible, elastic material bonded to the core (32), said calender belt (30) having a web side (34) which contacts a paper or paperboard web (16) being calendered in said at least one press nip (14) and a press side (36) on the opposite side of said core (32) from said web side (34), characterized in that the calender belt (30) in its thickness direction has a first hardness on the web side (34), and a higher hardness, as compared with said first hardness, on the press side (36), said first hardness being so chosen that the surface (38) of the web side (34) of the calender belt (30) can adapt its shape in the press nip (14) to unevennesses in the surface (20) of a web (16).

2. A system as claimed in claim 1, characterized in that said first hardness is in the range of 75–91 Shore A.

3. A system as claimed in claim 2, characterized in that said first hardness is in the range of 80–91 Shore A.

4. A system as claimed in claim 1, characterized in that the web side (34) of the calender belt (30) exhibits a hardness gradient in its thickness direction.

5. A system as claimed in claim 4, characterized in that said hardness gradient of the web side of the calender belt (30) is provided by the web side (34) consisting of layers of different hardness.

6. A system as claimed in claim 1, characterized in that the press nip (14) exerts an average pressure force on the web (16) that is higher than 4 MPa.

7. A system as claimed in claim 1 characterized in that said compressible, elastic material is substantially non-porous.

8. A system as claimed in claim 1 characterized in that the calender belt (30) has a relatively thin surface layer **(34*c*) on said web side (34), said surface layer (34*c*) having a hardness that is higher than said first hardness, said hard surface layer (34*c*) being sufficiently flexible that the surface (38) of the web side (34) can adapt its shape in a press nip (14) to unevennesses in the surface (20) of a web (16)**.

9. A system as claimed in claim 1 characterized in that the calender belt (30), on its web side (34), comprises a barrier layer **(34*b*) below said surface (38) of said web side (34), said barrier layer (34*b*) having a relatively low extensibility in the machine and cross-machine directions,to counteract the generation, as a result of shear movements in said directions of the web side (34) of the belt (30) produced by the compression of the web side (34), of undesired shear forces acting on the fibres of a web (16) in contact with said surface (38)**.

10. A system as claimed in claim 1 characterized in that the calender belt (30) has a friction-increasing surface layer **(34*c*) on said web side (34) to counteract relative sliding in the machine direction between the calender belt (30) and a web (16)**.

11. A system as claimed in claim 1 claims, characterized h a r a c t e r i s e d in that the elastic and compressible material bonded to the core (32) of the calender belt (30) is impermeable.

12. A system as claimed in claim 1 characterized in that the web side (34) of the calender belt (30) is thicker than the press side thereof ($t_b > t_p$).

13. A system as claimed in claim 1 characterized in that the core (32) of the calender belt (30) has, as compared with the rest of the belt (30), lower extensibility in the machine and cross-machine directions.

14. A system as claimed in claim 1 characterized in that the core (32) has about the same extensibility in the machine and cross-machine directions.

15. A system as claimed in claim 1 characterized in that the press nip (14) is formed between rotating rolls (10, 12).

16. A system as claimed in claim 15, characterized in that the calender belt (30) has a length equal to the circumference of one (12) of said two rotating rolls (10,12), thereby being a roll covering for said rotating roll (12), the other roll (10) being heated.

17. A system as claimed in claim 15, characterized in that the calender belt (30) passes through the press nip (14) as a belt (30) independent of the two rotating rolls (10, 12).

18. A system as claimed in claim 1, characterized in that the press nip (14) is an extended press nip formed between a rotating, heated roll (10) and a substantially stationary press shoe (40), the calender belt (30) passing in an endless path (42) around the press shoe (40).

* * * * *